US005690305A

United States Patent [19]

Perkins

[11] Patent Number: 5,690,305

[45] Date of Patent: Nov. 25, 1997

[54] BRACKET FOR POSITIONING SKIRTING ON A MANUFACTURED BUILDING

[76] Inventor: Kristine M. Perkins, 4260 McConnell Blvd., Culver City, Calif. 90066

[21] Appl. No.: 590,115

[22] Filed: Jan. 23, 1996

[51] Int. Cl.[6] ..... F16M 11/00

[52] U.S. Cl. ..... 248/200; 248/351; 52/169.12; 52/DIG. 3

[58] Field of Search ..... 248/200, 240, 248/273, 351, 354.1, 354.5, 200.1; 52/DIG. 3, DIG. 11, 169.12, 27, 143; 49/381

[56] References Cited

U.S. PATENT DOCUMENTS

| | | | |
|---|---|---|---|
| 867,274 | 10/1907 | Humphries | 52/27 |
| 970,777 | 9/1910 | Ackerman | 248/240 X |
| 1,059,467 | 4/1913 | Hoy | 248/240 X |
| 3,500,430 | 3/1970 | Rex | 52/27 |
| 3,775,917 | 12/1973 | Struben | 52/169.12 |
| 4,510,502 | 4/1985 | Hovland et al. | 52/27 X |

*Primary Examiner*—Robert W. Gibson, Jr.
*Assistant Examiner*—Stephen S. Wentsler
*Attorney, Agent, or Firm*—Thomas W. Secrest

[57] ABSTRACT

The subject matter is a bracket to a system for attaching a skirt to a building. The building is off of the ground and there is a distance between the lower part of the building and the ground. It is desirable to cover the open space between the building and the ground. This is usually done by a skirt. The bracket may comprise two or three pieces and can be attached to the underneath part of the building. Then, the skirt can be attached to the bracket. The building is often a manufactured house or a mobile home.

13 Claims, 9 Drawing Sheets

BRACKET FOR POSITIONING SKIRTING ON A MANUFACTURED BUILDING

CROSS-REFERENCES TO RELATED PATENT APPLICATIONS

There is no related application.

STATEMENT AS TO RIGHTS TO INVENTIONS MADE UNDER

FEDERALLY SPONSORED RESEARCH AND DEVELOPMENT

This invention was made with private money by an individual. There was no federally sponsored research and development in regard to this invention.

BACKGROUND OF THE INVENTION

1. FIELD OF THE INVENTION

The present invention relates to a bracket which can be attached to a manufactured building. Then, a skirt may be attached to the bracket. This provides a cover for that area underneath the manufactured building so as to preclude wind, rain and snow, as well as small animals, going under the manufactured building.

2. DESCRIPTION OF THE PRIOR ART

There are available teachings in regard to brackets used for attaching skirting to a manufactured building. Some of these teachings attempt to solve the problem of attaching skirting to the lower part and underneath a manufactured building. Examples of such teachings are described in the following United States patents. There is a patent of Hindman (1974), U.S. Pat. No. 3,832,813. Then there are patents to Nesbit (1973), U.S. Pat. No. 3,753,323; Hanson, Sr. (1978), U.S. Pat. No. 4,112,638; Unruh (1973), U.S. Pat. NO. 4,001,361; and Struben (1973), U.S. Pat. No. 3,775,917. These patents teach of brackets different than the bracket of this invention and patent application. Therefore, there should be no conflict between the subject matter of this patent application and the subject matters of these patents.

These brackets attach to the outside of the manufactured building. These brackets lack an added arm for support. This does not allow sufficient support in adverse weather conditions to sustain the skirt on the manufactured building. The skirt is normally a sheet metal panel and has a relatively large surface area and is relatively thin. With the wind blowing against the skirt there is required a strong supporting bracket. These patents teach of a bracket that attaches to the outside of the manufactured building. Also, the bracket is staked into the ground. In attaching the bracket to the manufactured building, the staking of a bracket into the ground is time-consuming and therefore expensive. One disadvantage of pounding a stake into the ground is that with the passage of time the wooden stake rots and does not provide support for the skirt.

SUMMARY OF THE INVENTION

This invention is directed to a bracket to be attached to the outer underneath side of a manufactured building. The bracket acts as a support for a skirt from the outer underneath side of a manufactured building.

The bracket may make two forms.

The first form is a front upright bracket and a diagonal support bracket. On the outer part of the front upright bracket, there is attached a wooden nailing strip. The front upright bracket is attached to the outer and lower part of a manufactured building. The diagonal support bracket is attached to a lower end of a front upright bracket and also to a beam or floor joist. The diagonal support bracket gives support to the front upright bracket at the lower end. The front upright bracket is secured at the upper end.

The second bracket is comprised of three parts. There is a front upright bracket, an upper support bracket and a diagonal support bracket. The upper part of the front upright bracket is attached to the outer part of the upper support bracket. The lower outer part of the diagonal support bracket is attached to the lower part of the front upright bracket. The inner upper part of the diagonal support bracket is attached to the upper support bracket. Again, on the outer face of the front upright bracket there is a wooden nailing strip.

The front upright bracket can be attached to the underside of the manufactured building. The upper support bracket can be attached to the underside of the manufactured building. There is support for the upper part of the front upright bracket by being attached to the manufactured building. There is support for the lower part of the front upright bracket because of the diagonal support bracket being attached to the lower part of the front upright bracket. The skirt or panel can be attached to the wooden nailing strip by means of a nail, a screw, a rivet or other appropriate means.

The front upright bracket, diagonal support bracket and upper support bracket can be made of galvanized sheet metal.

OBJECTS AND ADVANTAGES

There are numerous objects and advantages to this invention in regard to applying skirting to a manufactured building.

One of these objects and advantages is to provide a bracket which will readily and inexpensively accept the skirt;

Another object is a bracket supported by the manufactured building;

Another object is to provide a bracket whereby there is an easy attachment of the skirt to the bracket for a lower cost in applying the skirt to the manufactured building;

Another object is to provide a bracket holding a skirt and provision for easy removal of the skirt from the bracket;

Another object is to provide a bracket which can be easily adjusted to various locations of manufactured buildings;

Another object is a provision of a bracket which is easily adjustable as to the vertical length of the bracket and also to accommodate the vertical height of a skirt;

Another object is to provide a sturdy bracket for positioning skirting to withstand the wind and the rain and the elements; and, Another object is to provide a bracket whereby the vertical height of the bracket can be adjusted at the construction site.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

In the drawings, it is seen that

DESCRIPTION OF THE PREFERRED EMBODIMENT(S)

Figure 1:
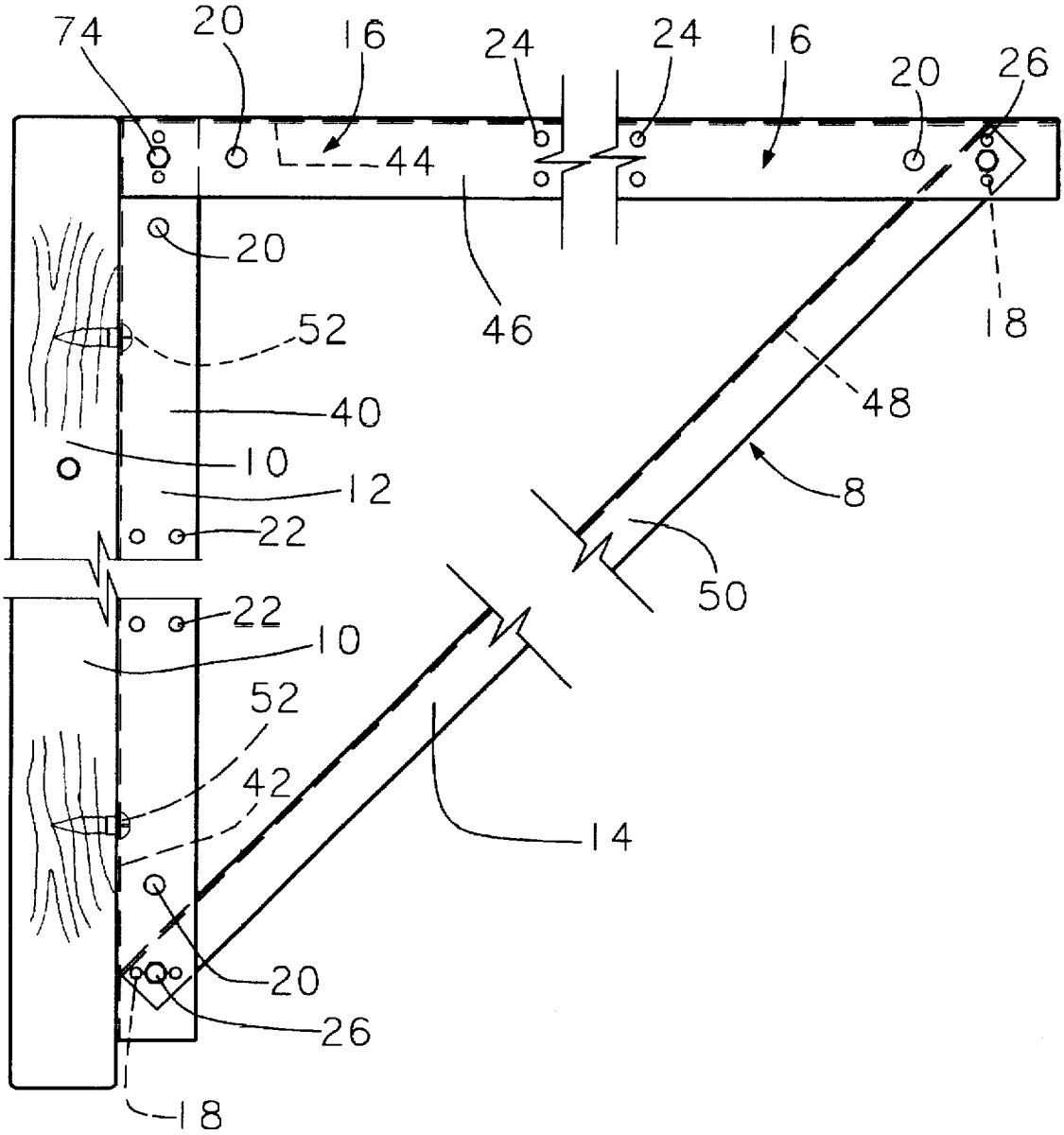
FIG. 1 is a side-elevational view of a bracket having a horizontal member, a vertical member, a diagonal support member, and an outside facing member on the vertical member.

With reference to the drawings, it is seen that there is a bracket 8 comprising a vertical member 12, a horizontal upper member 16 and a diagonal support member 14. The diagonal support member 14 connects with the lower part of the vertical member 12 and with the inner part of the horizontal upper member 16.

On the outside surface of the vertical member 12 there is a facing member 10. Facing member 10 is a 2"×2" treated wood block of indefinite length. The length can be determined at the construction site. The excess length can be removed at the construction site. The members 12, 14 and 16 are galvanized angle iron or an angle member. An and view of 10, 12, 14 and 16 is presented in FIG. 11.

Figure 7:
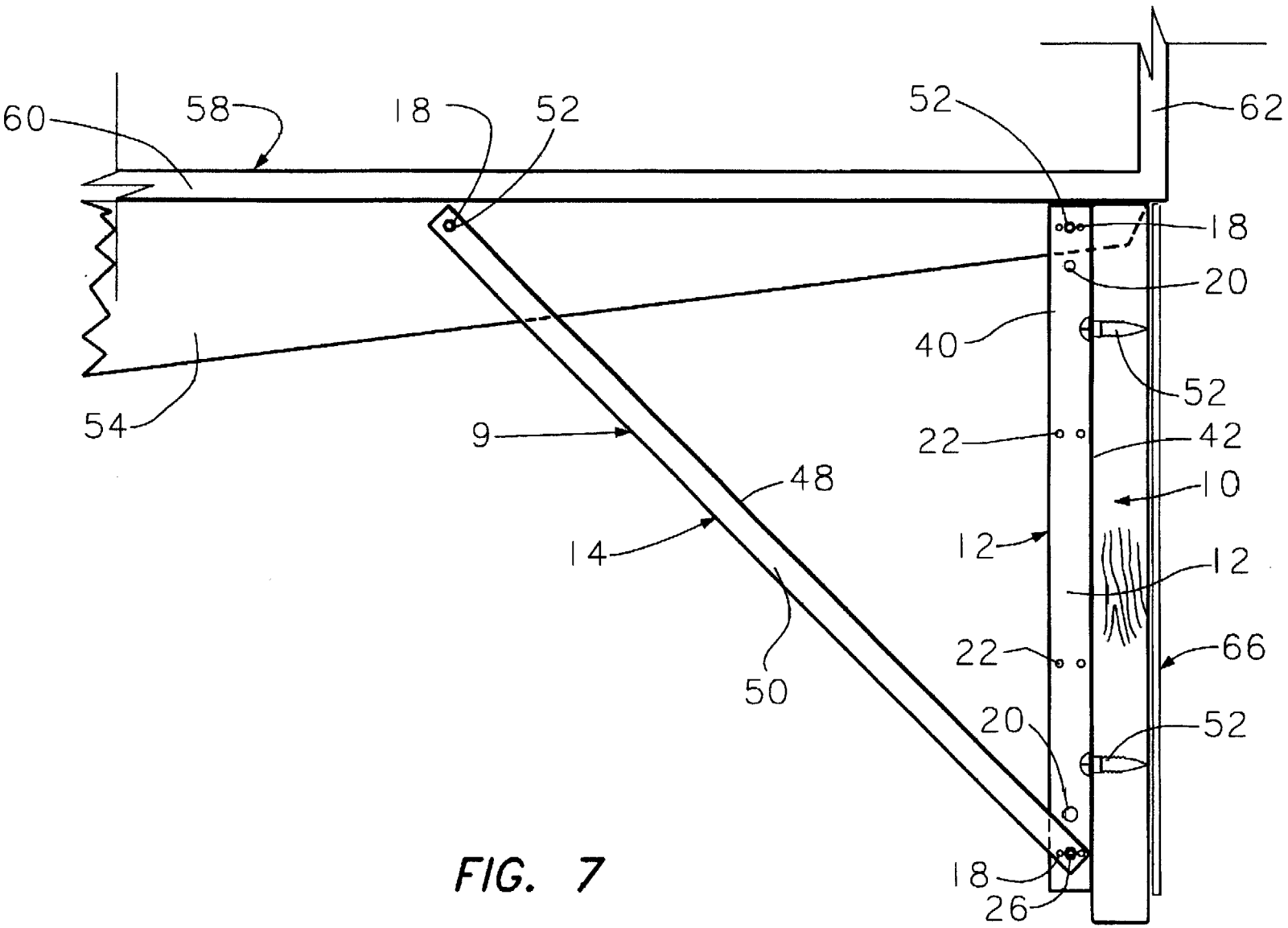
FIG. 7 is a side-elevational view of another form of the bracket as being attached to the underside of a manufactured building and illustrates the vertical member and the diagonal support member wherein the diagonal support member connects with the lower part of the vertical member and also with part of the manufactured building.

In FIG. 7 there is illustrated a bracket 9 comprising the vertical member 12 and the diagonal support member 14. There is no upper horizontal member with bracket 9.

It is seen that vertical member 12 is galvanized angle iron or angle member having legs 40 and 42 at an angle to each other.

The diagonal support member 14 is galvanized angle iron or angle member having legs 48 and 50 at an angle to each other.

Horizontal upper member 16 is galvanized angle iron or angle member having legs 44 and 46 at an angle to each other.

Figures 11, 12, 13, 14:
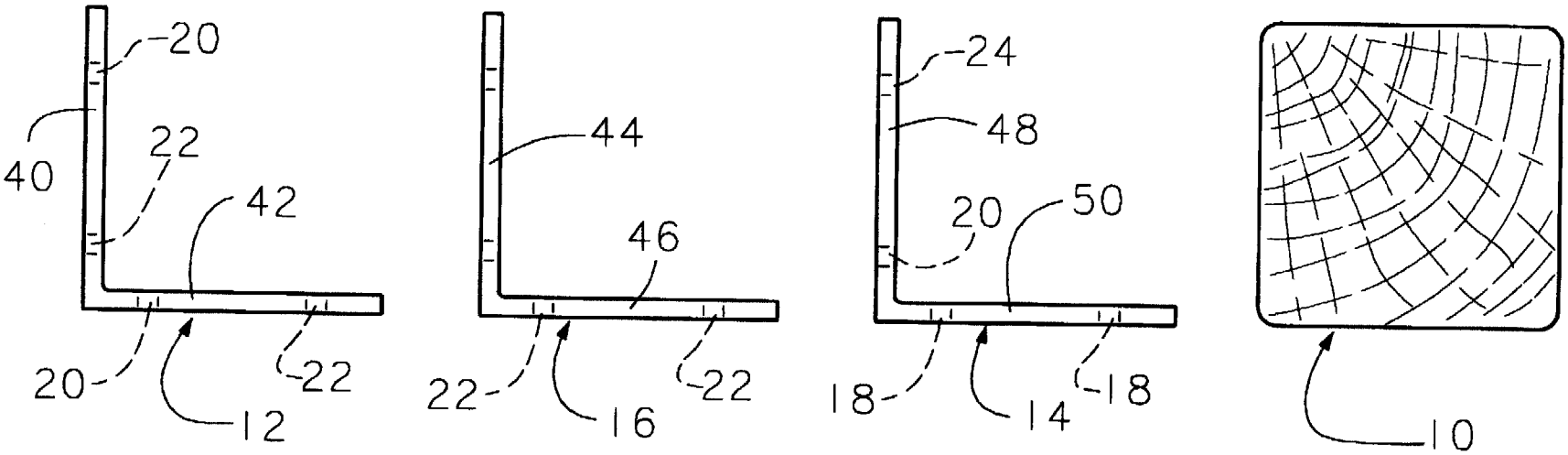
FIG. 12 is an end view of a horizontal member.
FIG. 13 is an end view of a diagonal member.
FIG. 14 is an end view of a facing member.

Facing member 10 is a material which will accept nails and screws. It is a piece of wood or a piece of plastic or other appropriate material which will accept nails and screws. FIG. 11 illustrates the member 10 which has a square cross-section. From experience, the inventor has found that the member 10 with a square cross-section is suitable for receiving a nail or a screw and for supporting the skirt for the manufactured building. At times, it may be appropriate for member 10 to have a cross-section other than a square cross-section.

With reference to the vertical member 12 and FIG. 1, it is seen that the leg 40 has a number of passageways or holes 22.

These passageways or holes 22 are 3/16-inch holes. Then, there are passageways and holes 20 for 17/64-inch holes. Also, at each end of the vertical member 12 and in the leg 40 there are 17/64-inch holes 20 for receiving the horizontal upper member 16 and also the diagonal support member 14 and appropriate nuts and bolts.

In the leg 42 of the vertical member 12, there are spaced-apart holes 22 and 20. These holes assist in uniting the facing member 10 and the vertical member 12.

Figure 2:
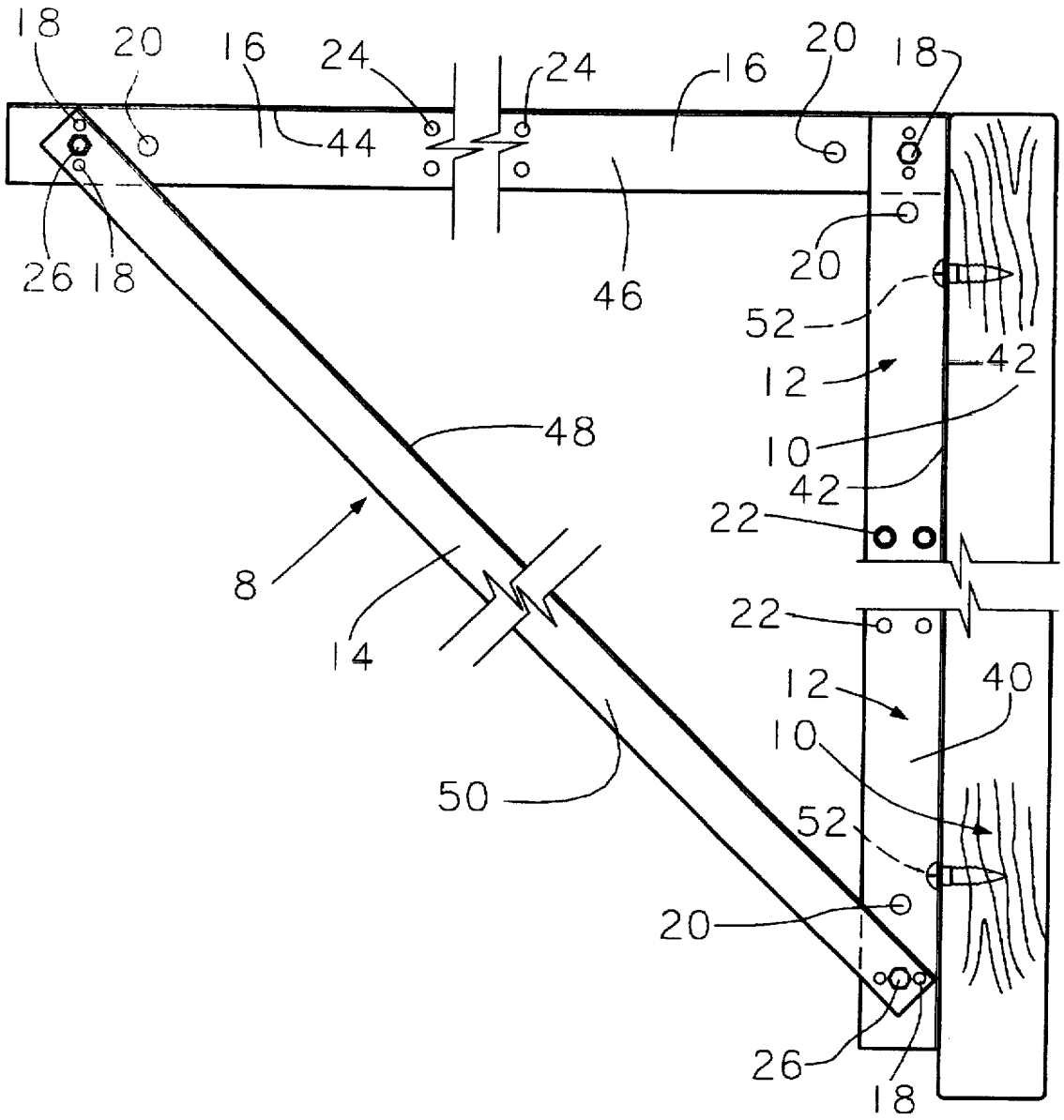
FIG. 2 is a side-elevational view of the bracket of FIG. 1, but from the other side of the bracket.
Figure 3:
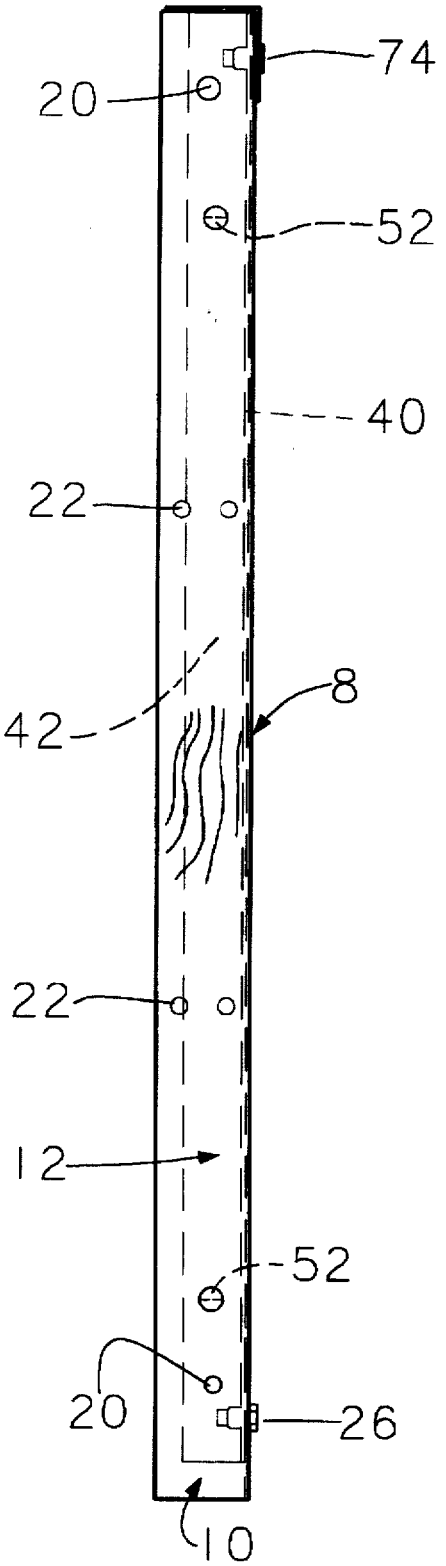
FIG. 3 is a front elevational view of the facing material on the outer surface of the vertical member of the bracket.
Figure 4:
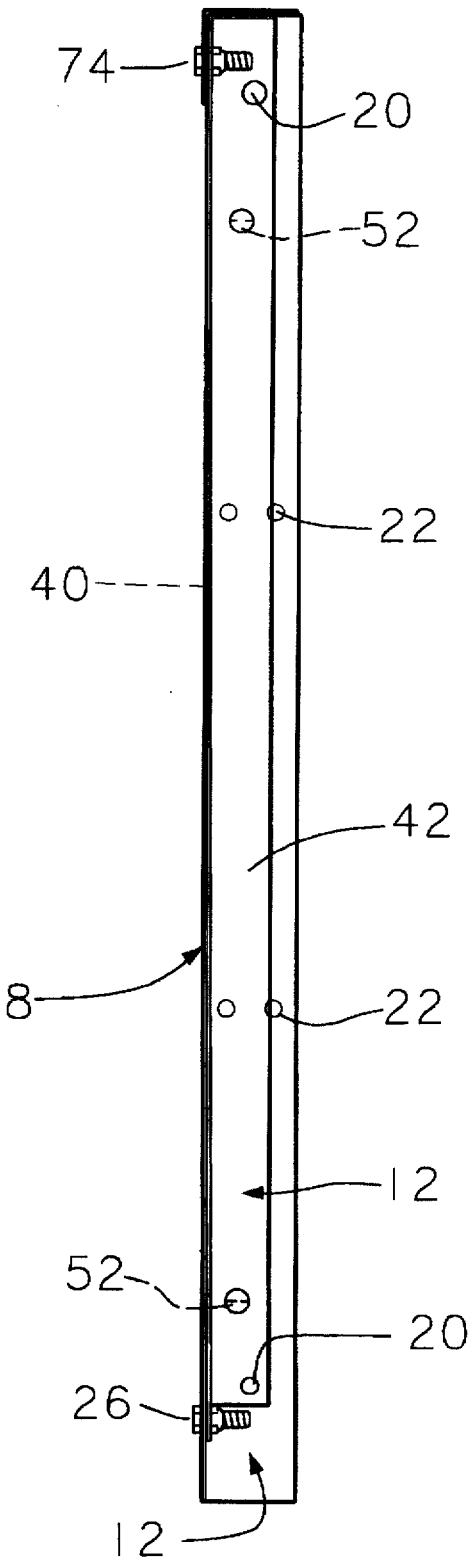
FIG. 4 is a view taken from the rear of the bracket and shows only the vertical support and facing material on the vertical support.

In FIGS. 1 and 2 it is seen that the horizontal upper member 16 has in the leg 46 spaced-apart holes 24 for 3/16-inch holes and spaced-apart holes 20 for 17/64-inch holes. At each end of 46 there are 17/64-inch holes 20 or passageways.

Figure 5:
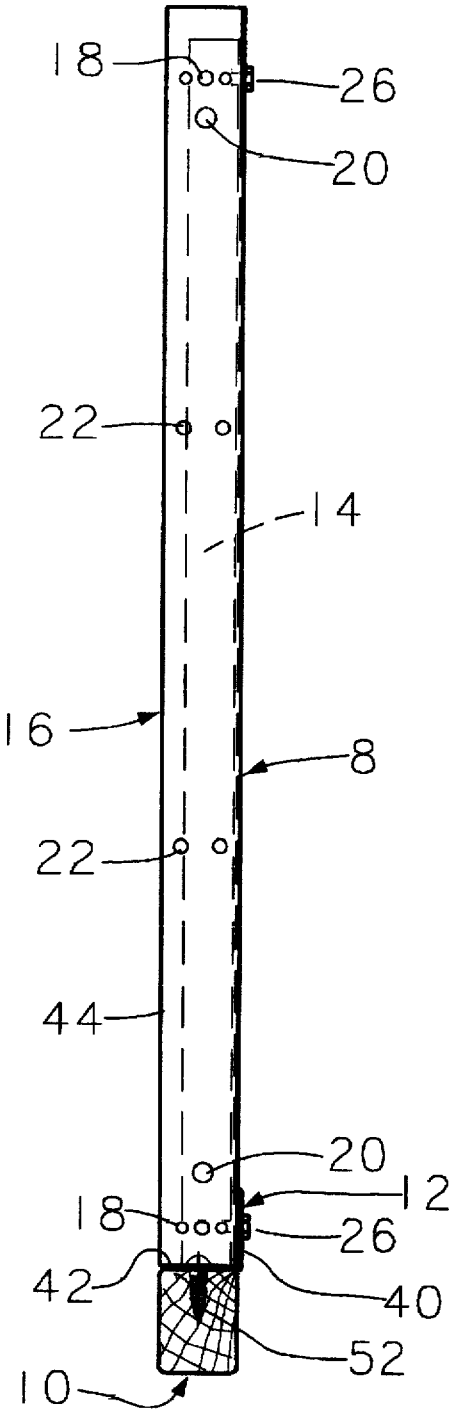
FIG. 5 is a top plan view looking down on the horizontal upper member and also the facing member.
Figure 6:
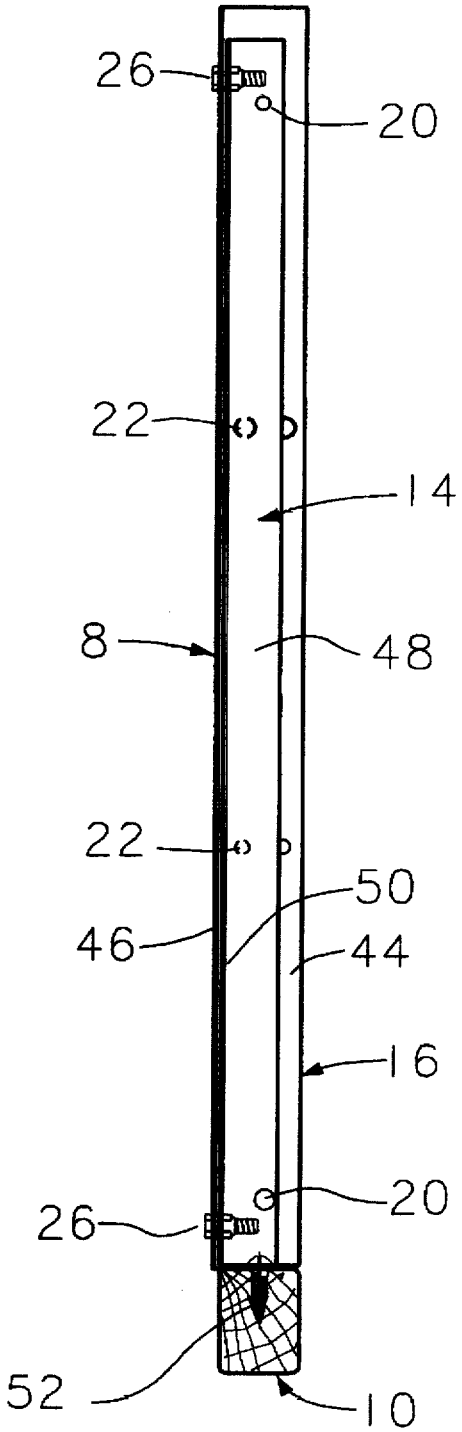
FIG. 6 is a bottom plan view looking at the diagonal support member; the horizontal upper member; the vertical member and the facing member on the vertical member.

In FIG. 5, it is seen that the horizontal upper member 16 in leg 44 has spaced-apart holes 22 for 3/16-inch holes and spaced apart holes 20 for 17/64-inch holes. At each end of leg 44 there is a 17/64-inch hole 20 for receiving a bolt and nut.

The diagonal support member 14 has at each end in the leg 50 a 17/64-inch hole 18. In the leg 48 there may be spaced-apart 3/16-inch holes 22 and 17/64-inch holes 20.

The angle irons or angle members 12, 14 and 16 along with the facing material 10 can be readily assembled into the bracket 8 or into the bracket 9. In FIGS. 1–6 and 8, it is seen that the horizontal upper member 16 and the vertical member 12 are at right angles to each other. These two members are joined at the upper part of 12 and the outer part of 16 by a nut and bolt combination in the 17/64-inch holes 18.

The diagonal support member 14 connects with the inner part of the horizontal upper member 16 by a nut and bolt combination 26 through the holes or passageways 18 in each of these members. The lower end of the diagonal support member 14 connects with the vertical member 12 by nut and bolt combination 26 in the 17/64-inch holes 18.

The facing member 10 can be applied to the outer surface of the leg 42 by means of screws 52 through holes 22 in the leg 42. This completes the bracket 8.

In FIG. 7, it is seen that the bracket 9 comprises the diagonal support member 14 which connects at its lower end with the lower end of the vertical member 12 by means of nut and bolt combination 26 through the holes 18 in member 14 and member 12.

The upper and inner end of 14 can be attached to a metal frame extension 54 by means of a screw 52 through hole 18.

In FIG. 5, it is seen that in the leg 44 at each end of the horizontal upper member 16 there are a number of holes or passageways 18. In the middle section of 16 there are holes and passageways 22.

Figure 8:
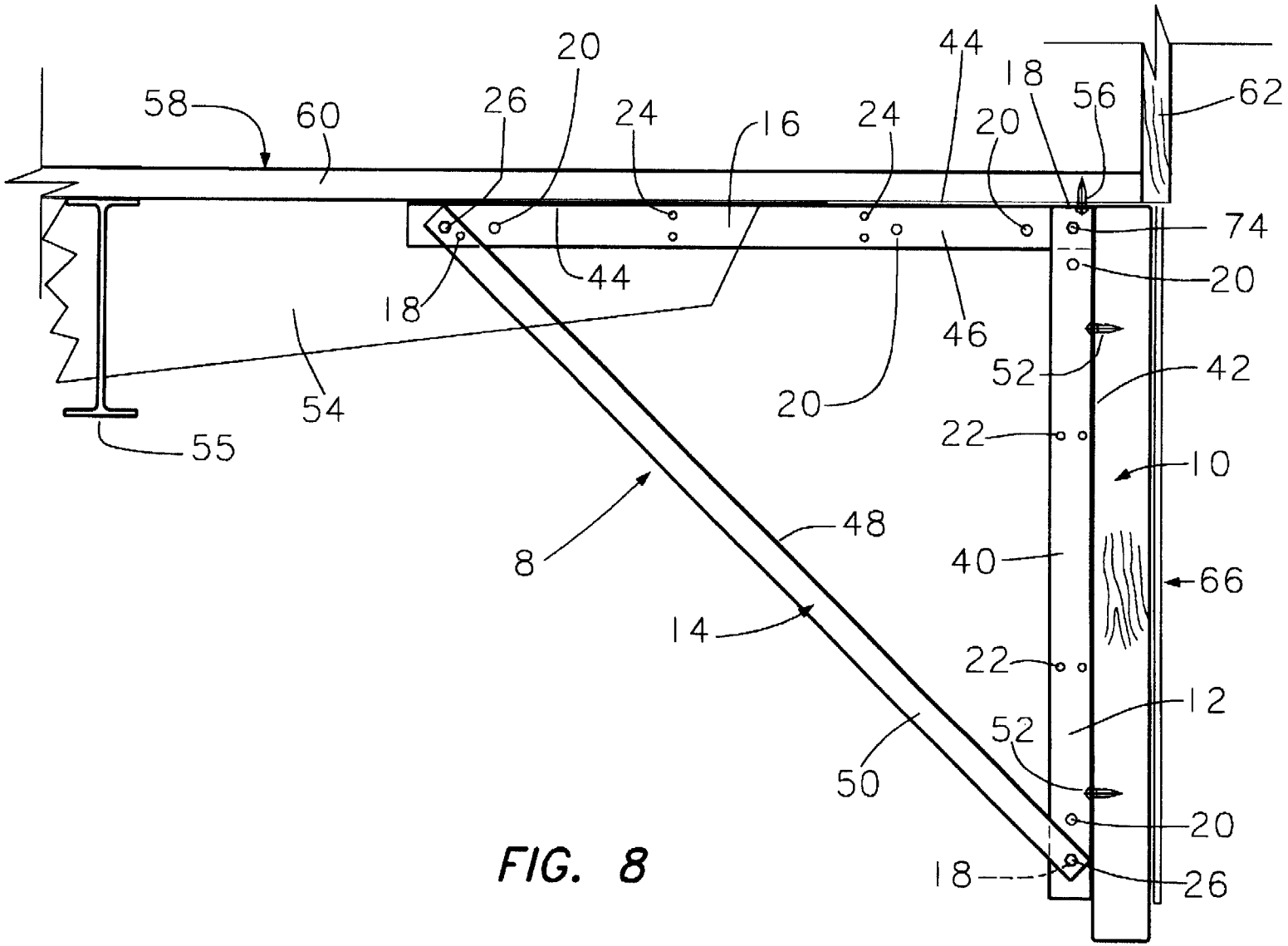
FIG. 8 is a side-elevational view of the bracket 8 illustrating the horizontal upper member being attached to the underside of the manufactured building, the vertical member, the diagonal support member and the facing member on the vertical member.

In FIG. 8, it is seen that the horizontal upper member 16 is attached to a wood floor joist 62 at the outer end and by means of screws 56 projecting through the holes 18 in leg 44. Also, the horizontal upper member 16 may be attached to the metal fram extension 54 by means of screws 56 projecting through the holes 22 in the leg 46 and into the frame extension 54.

In FIG. 7, it is seen that the bracket 9 is attached to the metal frame extension 54 by means of a screw 52 through hole 18 on the upper and inner end of the diagonal support member 14. Also, the vertical member 12 is attached to the metal frame extension 54 by means of screw 52 through hole 18 in the outer end of the frame extension 54.

In FIGS. 7 and 8, it is seen that there is a manufactured building 58 having a floor 60 and metal support frame 54 and an outer wall 62.

In FIG. 8, the horizontal upper member 16 is attached to the floor 60 by means of screws 56 in the leg 44 through the opening 18 at at the outer end of 16. This attachment is in addition to being attached to the metal frame extension 54. The bracket 8 is set inwardly of the outer surface of the outer wall 62. This allows the facing member 10 to be set back a small distance from the edge of the outer wall 62. This also allows the skirt 66 to be set inwardly from the wall 62 so that the water flows on the outside of the skirt 66. In FIG. 8 it is seen that there is a longitudinal I-beam 55 for supporting the frame extension 54 and the floor 60.

Also, the vertical member 12 is attached at its upper end to the metal support frame 54 by means of screws 52 passing through holes 18 in the leg 40. This assists in stabilizing the bracket 9. This allows the skirt 66 to be set inwardly from the wall 62 so that the water flows on the outside of the skirt 66.

Again, the bracket 9 is inset from the outer surface of the outer wall 62 and is underneath the floor 60. Further, the outer facing material 10 is also inset from the outer surface of the outer wall 62. This allows the skirt 66 to be set inwardly from the wall 62 so that the water flows on the outside of the skirt 66.

The length of the facing material 10 can be longer than the length of the vertical member 12. The facing material 10 can take nails and screws and other appropriate fastening means for attaching suitable skirt material 66 to the facing material 10. The length of the facing member 10 can be adjusted to the terrain of the ground by removing extra length.

Figure 9:
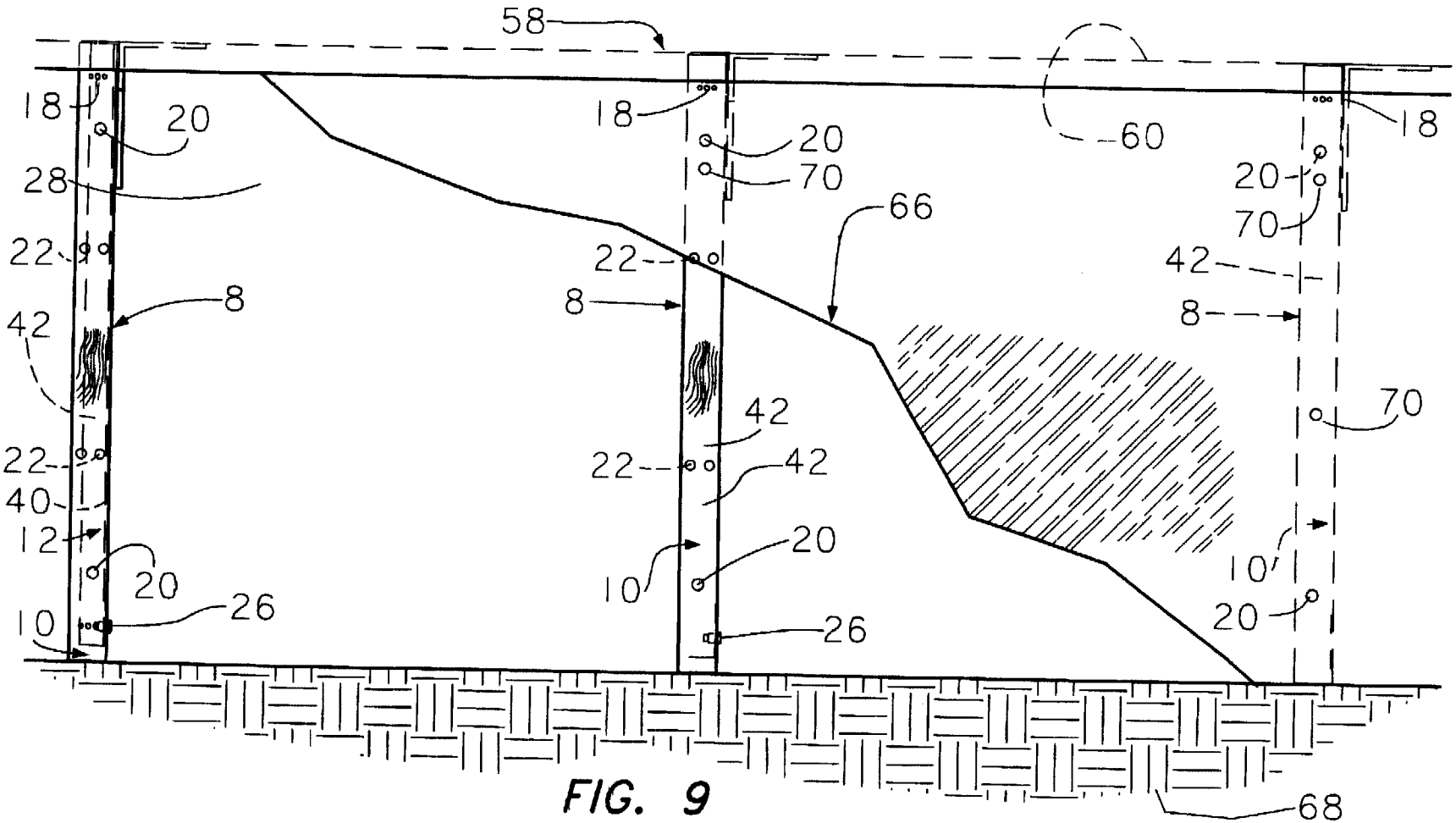
FIG. 9 is a front elevational view of the bracket as attached to the underside of the manufactured building and illustrating the vertical member, the facing member on the vertical member and the skirt attached to the facing member.

In FIG. 9, there is illustrated the lower part of the manufactured building 58 having a floor 60.

There is attached to the underneath sides of the floor 60, three spaced-apart brackets 8. On the outer part of each of these brackets, there is a facing material 10.

There is a skirt 66 of sheet metal or any other suitable material such as vinyl, wood, aluminum and sheet metal. The skirt 66 is shown in the fragmentary front elevational with the lower part of the skirt removed. The skirt 66 is applied to the facing material 10 on each of the brackets 8 by means of a screw or nail 70 or other appropriate fastening means.

Figure 10:
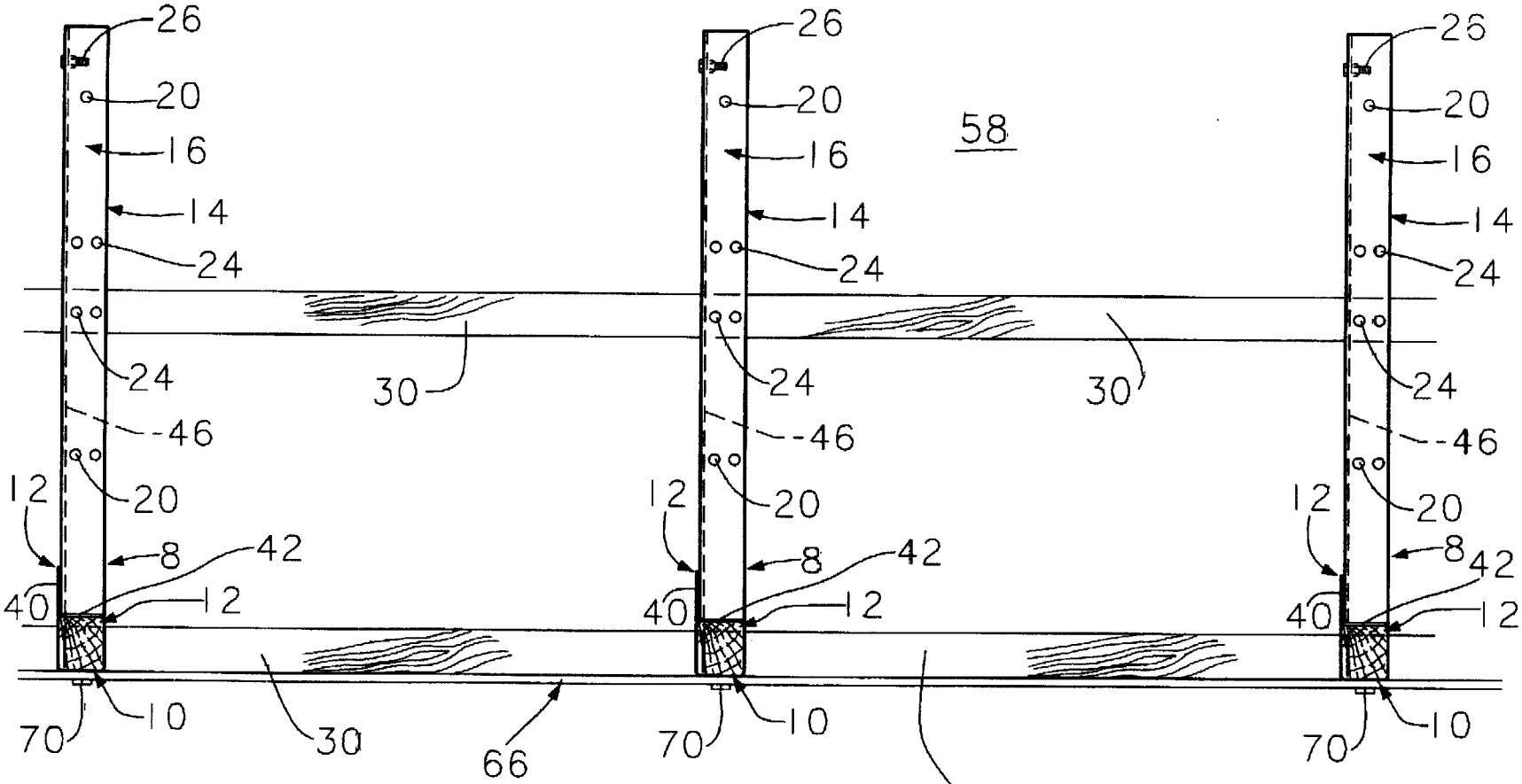
FIG. 10 is a top plan view of the bracket as attached to the underside of a manufactured building and illustrates the horizontal upper member, the vertical member and the facing member on the vertical member, and, FIG. 11 is an end view of a vertical member.

The manufactured building 58 rests on a ground 68 or base material 68. The ground 68 may be earth or may gravel on earth or may be a concrete pad to name a few suitable materials. FIG. 10 is a top plan view of the bracket as attached to the underside of a manufactured building, and illustrates a horizontal upper member 30, the vertical member 12, and the facing member 10 on the vertical member 12.

In FIG. 10, a top plan view, it is seen that the bracket 8 is attached to the underside of a manufactured building 58. Also, there is the diagonal support member 14 and the vertical member 12. On the outside of the vertical member 12, there is the facing member 10. Also, it is seen that the skirt 66 is attached to the facing member 10 by screw or nails 70 or other suitable fastening means.

The facing member 10 is positioned underneath the manufactured building and is seldom exposed to the elements as the manufactured building 58 protects the facing member 10. Further, the skirt 66 protects the facing member 10.

The facing member 10 can be approximately the same length as the vertical member 12, see FIGS. 1 and 2. In certain instances, the member 10 can be longer than the vertical member 12. This is a desirable feature as it makes the brackets 8 and 9 more versatile with the terrain of the ground on which the manufactured building 58 resides. The variable length of the facing member 10 makes it possible to have a more standard bracket 8 and a more standard bracket 9. The length of the facing member 10 can compensate for the standardized brackets 8 and 9 so that only a few brackets of desired size need be manufactured and stocked.

The vertical angle member 12 has legs 40 and 42 at an angle to each other. In these legs there are holes or passageways 18, 20 and 22 for receiving screws and nuts and bolts.

The diagonal angle member 14 has legs 48 and 50 at an angle to each other. In the legs 48 and 50 there are holes or passageways 18, 20 and 22. In the leg 48 there may be spaced-apart 3/16-inch holes 22 and 17/64-inch holes 20. The holes and passageways are for receiving screws and nuts and bolts.

The upper horizontal member 16 has legs 44 and 46 at an angle to each other. The legs 44 and 46 have holes or passageways 18, 20 and 24. The holes and passageways are for receiving screws and nuts and bolts.

The lower end of the vertical member 12 and the lower end of the diagonal member 14 may be joined by nut and bolt combination 26 in holes 20 and 18.

The upper end of the diagonal support member 14 connects with the inner part of the horizontal upper member 16 by a nut and bolt combination 26 in the holes or passageways 18 and 20.

The vertical member 12 and the upper horizontal member 16 are united by a nut and bolt combination 74 in the holes or passageways.

The facing material 10 may be united with the leg 42 by means of screws 52 in holes 22 and in the material 10.

A bracket for attaching to a first object and for receiving a second object and comprising a vertical member; a diagonal support member; a first uniting means for joining together said vertical member and said diagonal support member; a facing member for receiving an attaching means to attach said facing member to said second object; a second uniting means for joining together said vertical member and said facing member; a means to assist in attaching said vertical member to said first object; a means to assist in attaching said diagonal support member to said first object; horizontal upper member; a third uniting means for joining together said vertical member and said horizontal upper member; a fourth means for joining together said diagonal support member and said horizontal upper member; said vertical member being an angle member having a first leg and a second leg; said first leg and said second leg being at an angle to each other; said diagonal support member being an angle member having a third leg and a fourth leg; said third leg and said fourth leg being at an angle to each other; said horizontal upper member being an angle member having a fifth leg and a sixth leg; said fifth leg and said sixth leg being an angle to each other; said first uniting means joining together said first leg and said third leg; said second uniting means joining together said facing member and said second leg; said third uniting means joining together said first leg and said fifth leg; and, said fourth uniting means joining together said third leg and said fifth leg.

A bracket for attaching to a first object and for receiving a second object and comprising a vertical member; a diagonal support member; a first uniting means for joining together said vertical member and said diagonal support member; a facing member for receiving an attaching means to attach said facing member to said second object; a second uniting means for joining together said vertical member and said facing member; a means to assist in attaching said vertical member to said first object; a means to assist in attaching said diagonal support member to said first object; said vertical member being an angle member having a first leg and a second leg; said first leg and said second leg being at an angle to each other; said diagonal support member being an angle member having a third leg and a fourth leg; said third leg and said fourth leg being at an angle to each other; said first uniting means joining together said first leg and said third leg; said second uniting means joining together said facing member and said second leg.

A combination of a first object and a bracket for attaching to said first object and for receiving a second object and comprising a vertical member; a diagonal support member; a first uniting means for joining together said vertical member and said diagonal support member; a facing member for receiving an attaching means to attach said facing member to said second object; a second uniting means for joining together said vertical member and said facing member; a means to assist in attaching said vertical member to said first object; a means to assist in attaching said diagonal support member to said first object; said first object being a structure positioned off of the ground; said bracket being attached to the underneath part of said structure; said second object being a skirt for attachment to said vertical member; said skirt may cover the open area between the structure and the ground; a horizontal upper member; a third uniting means for joining together said vertical member and said horizontal upper member; a fourth means for joining together said diagonal support member and said horizontal upper member; said first object being a structure positioned off of the ground; said bracket being attached to the underneath part of said structure; said second object being a skirt for attachment to said vertical member; said skirt may cover the open area between the structure and the ground; said vertical member being an angle member having a first leg and a second leg; said first leg and said second leg being at an angle to each other; said diagonal support member being an angle member having a third leg and a fourth leg; said third leg and said fourth leg being at an angle to each other; said horizontal upper member being an angle member having a fifth leg and a sixth leg; said fifth leg and said sixth leg being at an angle to each other; said first uniting means joining together said first leg and said third leg; said second uniting means joining together said facing member and said second leg; said third uniting means joining together said first leg and said fifth leg; said fourth uniting means joining together said third leg and said fifth leg.

A combination of a first object and a bracket for attaching to said first object and for receiving a second object and comprising a vertical member; a diagonal support member; a first uniting means for joining together said vertical member and said diagonal support member; a facing member for receiving an attaching means to attach said facing member to said second object; a second uniting means for joining together said vertical member and said facing member; a means to assist in attaching said vertical member to said first object; a means to assist in attaching said diagonal support member to said first object; said first object being a structure positioned off of the ground; said bracket being attached to the underneath part of said structure; said second object being a skirt for attachment to said vertical member; said skirt may cover the open area between the structure and the ground; said vertical member being an angle member having a first leg and a second leg; said first leg and said second leg being at an angle to each other; said diagonal support member being an angle member having a third leg and a fourth leg; said third leg and said fourth leg being at an angle to each other; said first uniting means joining together said first leg and said third leg; said second uniting means joining together said facing member and said second leg.

A process for making a bracket for attaching to a first object and for receiving a second object and comprising selecting a vertical member; selecting a diagonal support member; joining together said vertical member and said diagonal support member with a first uniting means; selecting a facing member for receiving an attaching means to attach said facing member to said second object; joining together said vertical member and said facing member by a second uniting means; selecting a means to assist in attaching said vertical member to said first object; selecting a means to assist in attaching said diagonal support member to said first object; selecting a third uniting means for joining together said vertical member and said horizontal upper member; joining together said vertical member and said horizontal upper member with a third uniting means; joining together said diagonal support member and said horizontal upper member with a fourth means; selecting as said horizontal upper member an angle member having a fifth leg and a sixth leg with said fifth leg and said sixth leg being at an angle to each other; joining together said first leg and said third leg; joining together said first leg and said fifth leg; joining together said third leg and said fifth leg.

A process for making a bracket for attaching to a first object and for receiving a second object and comprising selecting a vertical member; selecting a diagonal support member; joining together said vertical member and said diagonal support member with a first uniting means; selecting a facing member for receiving an attaching means to attach said facing member to said second object; joining together said vertical member and said facing member by a second uniting means; selecting a means to assist in attaching said vertical member to said first object; selecting a means to assist in attaching said diagonal support member to said first object; selecting as said vertical member an angle member having a first leg and a second leg with said first leg and said second leg being at an angle to each other; selecting as said diagonal support member an angle member having a third leg and a fourth leg with said third leg and said fourth leg being at angle to each other; and, joining together said first leg and said third leg.

A process for making a combination of a first object and a bracket for attaching to said first object and for receiving a second object, said process comprising selecting a vertical member; selecting a diagonal support member; joining together said vertical member and said diagonal support member with a first uniting means; selecting a facing member for receiving an attaching means to attach said facing member to said second object; joining together said vertical member and said facing member by a second uniting means; selecting a means to assist in attaching said vertical member to said first object; selecting a means to assist in attaching said diagonal support member to said first object; said first object being a structure positioned off of the ground; attaching said bracket to the underneath part of said structure; said second object being a skirt for attachment to said vertical member; attaching a skirt to said facing member; said skirt may cover the open area between the structure and the ground; selecting a third uniting means for joining together said vertical member and said horizontal upper member; joining together said vertical member and said horizontal upper member with a third uniting means; joining together said diagonal support member and said horizontal upper member with a fourth means.

A process for making a combination of a first object and a bracket for attaching to said first object and for receiving a second object, said process comprising selecting a vertical member; selecting a diagonal support member; joining together said vertical member and said diagonal support member with a first uniting means; selecting a facing member for receiving an attaching means to attach said facing member to said second object; joining together said vertical member and said facing member by a second uniting means; selecting a means to assist in attaching said vertical member to said first object; selecting a means to assist in attaching said diagonal support member to said first object; said first object being a structure positioned off of the ground; attaching said bracket to the underneath part of said structure; said second object being a skirt for attachment to said vertical member; attaching a skirt to said facing member; said skirt may cover the open area between the structure and the ground; selecting as said vertical member an angle member having a first leg and a second leg with said first leg and said second leg being at an angle to each other; selecting as said diagonal support member an angle member having a third leg and a fourth leg with said third leg and said fourth leg being at angle to each other; and, joining together said first leg and said third leg.

A process for making a combination of a first object and a bracket for attaching to said first object and for receiving a second object, said process comprising selecting a vertical member; selecting a diagonal support member; joining together said vertical member and said diagonal support member with a first uniting means; selecting a facing member for receiving an attaching means to attach said facing member to said second object; joining together said vertical member and said facing member by a second uniting means; selecting a means to assist in attaching said vertical member to said first object; selecting a means to assist in attaching said diagonal support member to said first object; said first object being a structure positioned off of the ground; attaching said bracket to the underneath part of said structure; said second object being a skirt for attachment to said vertical member; attaching a skirt to said facing member; said skirt may cover the open area between the structure and the ground; selecting as said horizontal upper member an angle member having a fifth leg and a sixth leg with said fifth leg and said sixth leg being at an angle to each other; joining together said first leg and said third leg; joining together said first leg and said fifth leg; and, joining together said third leg and said fifth leg.

What I claim is:

1. A bracket for attaching to the lower part of a building and said bracket can be assembled at a construction site and employed for attaching to said building as a first object and for receiving a second object and comprising:

a. a vertical member;

b. a diagonal support member;

c. a first uniting means for joining together said vertical member and said diagonal support member;

d. said vertical member extending from said diagonal support to its upper end being juxtapositioned to said building;

e. a facing member for receiving an attaching means to attach said facing member to said second object;

f. said facing member being capable of receiving nails and screws;

g. said facing member being capable of being sized to a desirable length at said construction site;

h. a second uniting means for joining together said vertical member and said facing member;

i. a means to assist in attaching said vertical member to said first object;

j. a means to assist in attaching said diagonal support member to said first object;

k. horizontal upper member;

l. a third uniting means for joining together said vertical member and said horizontal upper member; and m. a fourth means for joining together said diagonal support member and said horizontal upper member.

2. A bracket for attaching to the lower part of a building and said bracket can be assembled at a construction site and employed for attaching to said building as a first object and for receiving a second object and comprising:

a. a vertical member;

b. a diagonal support member;

c. a first uniting means for joining together said vertical member and said diagonal support member;

d. said vertical member extending from said diagonal support to its upper end being juxtapositioned to said building;

e. a facing member for receiving an attaching means to attach said facing member to said second object;

f. said facing member being capable of receiving nails and screws;

g. said facing member being capable of being sized to a desirable length at said construction site;

h. a second uniting means for joining together said vertical member and said facing member;

i. a means to assist in attaching said vertical member to said first object;

j. a means to assist in attaching said diagonal support member to said first object;

k. horizontal upper member;

l. a third uniting means for joining together said vertical member and said horizontal upper member;

m. a fourth means for joining together said diagonal support member and said horizontal upper member;

n. said vertical member being an angle member having a first leg and a second leg;

o. said first leg and said second leg being at an angle to each other;

p. said diagonal support member being an angle member having a third leg and a fourth leg;

q. said third leg and said fourth leg being at an angle to each other;

r. said horizontal upper member being an angle member having a fifth leg and a sixth leg; and s. said fifth leg and said sixth leg being an angle to each other.

3. A bracket for attaching to the lower part of a building and said bracket can be assembled at a construction site and employed for attaching to said building as a first object and for receiving a second object and comprising:

a. a vertical member;

b. a diagonal support member;

c. a first uniting means for joining together said vertical member and said diagonal support member;

d. said vertical member extending from said diagonal support to its upper end being juxtapositioned to said building;

e. a facing member for receiving an attaching means to attach said facing member to said second object;

f. said facing member being capable of receiving nails and screws;

g. said facing member being capable of being sized to a desirable length at said construction site;

h. a second uniting means for joining together said vertical member and said facing member;

i. a means to assist in attaching said vertical member to said first object;

j. a means to assist in attaching said diagonal support member to said first object;

k. said vertical member being an angle member having a first leg and a second leg;

l. said first leg and said second leg being at an angle to each other;

m. said diagonal support member being an angle member having a third leg and a fourth leg;

n. said third leg and said fourth leg being at an angle to each other;

o. said first uniting means joining together said first leg and said third leg; and p. said second uniting means joining together said facing member and said second leg.

4. A bracket for attaching to the lower part of a building and said bracket can be assembled at a construction site and employed for attaching to said building as a first object and for receiving a second object and comprising:

a. a vertical member;

b. a diagonal support member;

c. a first uniting means for joining together said vertical member and said diagonal support member;

d. said vertical member extending from said diagonal support to its upper end being juxtapositioned to said building;

e. a facing member for receiving an attaching means to attach said facing member to said second object;

f. said facing member being capable of receiving nails and screws;

g. said facing member being capable of being sized to a desirable length at said construction site;

h. a second uniting means for joining together said vertical member and said facing member;

i. a means to assist in attaching said vertical member to said first object;

j. a means to assist in attaching said diagonal support member to said first object;

k. horizontal upper member;

l. a third uniting means for joining together said vertical member and said horizontal upper member;

m. a fourth means for joining together said diagonal support member and said horizontal upper member;

n. said vertical member being an angle member having a first leg and a second leg;

o. said first leg and said second leg being at an angle to each other;

p. said diagonal support member being an angle member having a third leg and a fourth leg;

q. said third leg and said fourth leg being at an angle to each other;

r. said horizontal upper member being an angle member having a fifth leg and a sixth leg;

s. said fifth leg and said sixth leg being an angle to each other;

t. said first uniting means joining together said first leg and said third leg;

u. said second uniting means joining together said facing member and said second leg;

v. said third uniting means joining together said first leg and said fifth leg; and w. said fourth uniting means joining together said third leg and said fifth leg.

5. A combination of a first object and a bracket for attaching to the lower part of a building and said bracket can be assembled at a construction site for attaching to said building as said first object and for receiving a second object and comprising:

a. a vertical member;

b. a diagonal support member;

c. a first uniting means for joining together said vertical member and said diagonal support member;

d. a facing member for receiving an attaching means to attach said facing member to said second object;

e. said facing member being capable of receiving nails and screws;

f. said facing member being capable of being sized to a desirable length at said construction site;

g. a second uniting means for joining together said vertical member and said facing member;

h. a means to assist in attaching said vertical member to said first object;

i. a means to assist in attaching said diagonal support member to said first object;

j. said first object being a structure positioned off of the ground;

k. said bracket being attached to the underneath part of said structure;

l. said vertical member extending from said diagonal support member to the underneath part of said structure so that its upper end is juxtapositioned to said structure;

m. said second object being a skirt for attachment to said facing member;

n. said skirt may cover the open area between the structure and the ground;

o. said vertical member being an angle member having a first leg and a second leg;

p. said first leg and said second leg being at an angle to each other;

q. said diagonal support member being an angle member having a third leg and a fourth leg;

r. said third leg and said fourth leg being at an angle to each other;

s. said first uniting means joining together said first leg and said third leg; and t. said second uniting means joining together said facing member and said second leg.

6. A combination of a first object and a bracket for attaching to said first object and for receiving a second object and comprising:

a. a vertical member;

b. a diagonal support member;

c. a first uniting means for joining together said vertical member and said diagonal support member;

d. a facing member for receiving an attaching means to attach said facing member to said second object;

e. a second uniting means for joining together said vertical member and said facing member;

f. a means to assist in attaching said vertical member to said first object;

g. a means to assist in attaching said diagonal support member to said first object;

h. said first object being a structure positioned off of the ground;

i. said bracket being attached to the underneath part of said structure;

j. said second object being a skirt for attachment to said facing member;

k. said skirt may cover the open area between the structure and the ground;

l. a horizontal upper member;

m. a third uniting means for joining together said vertical member and said horizontal upper member; and n. a fourth means for joining together said diagonal support member and said horizontal upper member.

7. A combination of a first object and a bracket for attaching to said first object and for receiving a second object and comprising:

a. a vertical member;

b. a diagonal support member;

c. a first uniting means for joining together said vertical member and said diagonal support member;

d. a facing member for receiving an attaching means to attach said facing member to said second object;

e. a second uniting means for joining together said vertical member and said facing member;

f. a means to assist in attaching said vertical member to said first object;

g. a means to assist in attaching said diagonal support member to said first object;

h. said first object being a structure positioned off of the ground;

i. said bracket being attached to the underneath part of said structure;

j. said second object being a skirt for attachment to said facing member;

k. said skirt may cover the open area between the structure and the ground;

l. a horizontal upper member;

m. a third uniting means for joining together said vertical member and said horizontal upper member;

n. a fourth means for joining together said diagonal support member and said horizontal upper member;

o. said vertical member being an angle member having a first leg and a second leg;

p. said first leg and said second leg being at an angle to each other;

q. said diagonal support member being an angle member having a third leg and a fourth leg;

r. said third leg and said fourth leg being at an angle to each other;

s. said horizontal upper member being an angle member having a fifth leg and a sixth leg; and t. said fifth leg and said sixth leg being at an angle to each other.

8. A combination of a first object and a bracket for attaching to said first object and for receiving a second object and comprising:

a. a vertical member;

b. a diagonal support member;

c. a first uniting means for joining together said vertical member and said diagonal support member;

d. a facing member for receiving an attaching means to attach said facing member to said second object;

e. a second uniting means for joining together said vertical member and said facing member;

f. a means to assist in attaching said vertical member to said first object;

g. a means to assist in attaching said diagonal support member to said first object;

h. said first object being a structure positioned off of the ground;

i. said bracket being attached to the underneath part of said structure;

j. said second object being a skirt for attachment to said facing member;

k. said skirt may cover the open area between the structure and the ground;

l. said vertical member being an angle member having a first leg and a second leg;

m. said first leg and said second leg being at an angle to each other;

n. said diagonal support member being an angle member having a third leg and a fourth leg;

o. said third leg and said fourth leg being at an angle to each other;

p. said first uniting means joining together said first leg and said third leg; and q. said second uniting means joining together said facing member and said second leg.

9. A combination of a first object and a bracket for attaching to said first object and for receiving a second object and comprising:

a. a vertical member;

b. a diagonal support member;

c. a first uniting means for joining together said vertical member and said diagonal support member;

d. a facing member for receiving an attaching means to attach said facing member to said second object;

e. a second uniting means for joining together said vertical member and said facing member;

f. a means to assist in attaching said vertical member to said first object;

g. a means to assist in attaching said diagonal support member to said first object;

h. said first object being a structure positioned off of the ground;

i. said bracket being attached to the underneath part of said structure;

j. said second object being a skirt for attachment to said facing member;

k. said skirt may cover the open area between the structure and the ground;

l. a horizontal upper member;

m. a third uniting means for joining together said vertical member and said horizontal upper member;

n. a fourth means for joining together said diagonal support member and said horizontal upper member;

o. said vertical member being an angle member having a first leg and a second leg;

p. said first leg and said second leg being at an angle to each other;

q. said diagonal support member being an angle member having a third leg and a fourth leg;

r. said third leg and said fourth leg being at an angle to each other;

s. said horizontal upper member being an angle member having a fifth leg and a sixth leg;

t. said fifth leg and said sixth leg being at an angle to each other;

u. said first uniting means joining together said first leg and said third leg;

v. said second uniting means joining together said facing member and said second leg;

w. said third uniting means joining together said first leg and said fifth leg; and, x. said fourth uniting means joining together said third leg and said fifth leg.

10. A process for making a combination of a first object and a bracket for attaching to said first object and for receiving a second object, said process comprising:

a. selecting a vertical member;

b. selecting a diagonal support member;

c. joining together said vertical member and said diagonal support member with a first uniting means;

d. selecting a facing member for receiving an attaching means to attach said facing member to said second object;

e. joining together said vertical member and said facing member by a second uniting means;

f. selecting a means to assist in attaching said vertical member to said first object;

g. selecting a means to assist in attaching said diagonal support member to said first object;

h. said first object being a structure positioned off of the ground;

i. attaching said bracket to the underneath part of said structure;

j. said second object being a skirt for attachment to said vertical member;

k. attaching said skirt to said facing member;

l. said skirt may cover the open area between the structure and the ground;

m. a horizontal upper member;

n. selecting a third uniting means for joining together said vertical member and said horizontal upper member;

o. joining together said vertical member and said horizontal upper member with said third uniting means;

p. selecting a fourth uniting means for joining together said diagonal support member and said horizontal upper member; and q. joining together said diagonal support member and said horizontal upper member with said fourth uniting means.

11. A process for making a combination of a first object and a bracket for attaching to said first object and for receiving a second object, said process comprising:

a. selecting a vertical member;

b. selecting a diagonal support member;

c. joining together said vertical member and said diagonal support member with a first uniting means;

d. selecting a facing member for receiving an attaching means to attach said facing member to said second object;

e. joining together said vertical member and said facing member by a second uniting means;

f. attaching said vertical member to said first object;

g. attaching said diagonal support member to said first object;

h. said first object being a structure positioned off of the ground;

i. attaching said bracket to the underneath part of said structure;

j. said second object being a skirt for attachment to said vertical member;

k. attaching said skirt to said facing member;

l. said skirt may cover the open area between the structure and the ground;

m. a horizontal upper member;

n. selecting a third uniting means for joining together said vertical member and said horizontal upper member;

o. joining together said vertical member and said horizontal upper member with said third uniting means;

p. joining together said diagonal support member and said horizontal upper member with a fourth means;

q. selecting as said vertical member an angle member having a first leg and a second leg with said first leg and said second leg being at an angle to each other;

r. selecting as said diagonal support member an angle member having a third leg and a fourth leg with said third leg and said fourth leg being at angle to each other; and s. selecting as said horizontal upper member an angle member having a fifth leg and a sixth leg with said fifth leg and said sixth leg being at an angle to each other.

12. A process for making a combination of a first object and a bracket for attaching to said first object and for receiving a second object, said process comprising:

a. selecting a vertical member;

b. selecting a diagonal support member;

c. joining together said vertical member and said diagonal support member with a first uniting means;

d. selecting a facing member for receiving an attaching means to attach said facing member to said second object;

e. joining together said vertical member and said facing member by a second uniting means;

f. attaching said vertical member to said first object;

g. attaching said diagonal support member to said first object;

h. said first object being a structure positioned off of the ground;

i. attaching said bracket to the underneath part of said structure;

j. said second object being a skirt for attachment to said vertical member;

k. attaching said skirt to said facing member;

l. said skirt may cover the open area between the structure and the ground;

m. a horizontal upper member;

n. selecting a third uniting means for joining together said vertical member and said horizontal upper member;

o. joining together said vertical member and said horizontal upper member with said third uniting means;

p. joining together said diagonal support member and said horizontal upper member with a fourth means;

q. selecting as said vertical member an angle member having a first leg and a second leg with said first leg and said second leg being at an angle to each other;

r. selecting as said diagonal support member an angle member having a third leg and a fourth leg with said third leg and said fourth leg being at angle to each other; and s. joining together said first leg and said third leg.

13. A process for making a combination of a first object and a bracket for attaching to said first object and for receiving a second object, said process comprising:

a. selecting a vertical member;

b. selecting a diagonal support member;

c. joining together said vertical member and said diagonal support member with a first uniting means;

d. selecting a facing member for receiving an attaching means to attach said facing member to said second object;

e. joining together said vertical member and said facing member by a second uniting means;

f. attaching said vertical member to said first object;

g. attaching said diagonal support member to said first object;

h. said first object being a structure positioned off of the ground;

i. attaching said bracket to the underneath part of said structure;

j. said second object being a skirt for attachment to said vertical member;

k. attaching said skirt to said facing member;

l. said skirt may cover the open area between the structure and the ground;

m. a horizontal upper member;

n. selecting a third uniting means for joining together said vertical member and said horizontal upper member;

o. joining together said vertical member and said horizontal upper member with said third uniting means;

p. joining together said diagonal support member and said horizontal upper member with a fourth means;

q. selecting as said vertical member an angle member having a first leg and a second leg with said first leg and said second leg being at an angle to each other;

r. selecting as said diagonal support member an angle member having a third leg and a fourth leg with said third leg and said fourth leg being at angle to each other;

s. selecting as said horizontal upper member an angle member having a fifth leg and a sixth leg with said fifth leg and said sixth leg being at an angle to each other;

t. joining together said first leg and said third leg;

u. joining together said first leg and said fifth leg; and v. joining together said third leg and said fifth leg.

* * * * *